US005909163A

United States Patent [19]

Posey

[11] Patent Number: 5,909,163

[45] Date of Patent: Jun. 1, 1999

[54] HIGH VOLTAGE REED SWITCH

[75] Inventor: William T. Posey, Chickasha, Okla.

[73] Assignee: Hermetic Switch, Inc., Chickasha, Okla.

[21] Appl. No.: 08/712,207

[22] Filed: Sep. 11, 1996

[51] Int. Cl.[6] ..... H01H 63/02

[52] U.S. Cl. ..... 335/151; 335/154

[58] Field of Search ..... 335/151–4, 58–66

[56] References Cited

U.S. PATENT DOCUMENTS

| | | | |
|---|---|---|---|
| 3,005,069 | 10/1961 | Sippach et al. . | |
| 3,250,886 | 5/1966 | De Lucia et al. . | |
| 3,315,193 | 4/1967 | Santi | 335/154 |
| 3,320,559 | 5/1967 | Morrison . | |
| 3,408,603 | 10/1968 | Morrison . | |
| 3,575,678 | 4/1971 | Barton | 335/151 |
| 3,582,844 | 6/1971 | Launt et al. . | |
| 3,586,809 | 6/1971 | Santi | 335/154 |
| 4,063,203 | 12/1977 | Fujiwara et al. | 335/151 |
| 4,228,412 | 10/1980 | Dalley et al. . | |
| 5,128,641 | 7/1992 | Posey | 335/151 |

FOREIGN PATENT DOCUMENTS

| | | |
|---|---|---|
| 781996 | 11/1980 | U.S.S.R. . |
| 849318 | 7/1981 | U.S.S.R. . |

*Primary Examiner*—Lincoln Donovan
*Attorney, Agent, or Firm*—Head, Johnson & Kachigian

[57] ABSTRACT

A high voltage reed switch that opens and closes in response to a magnetic flux field. The switch comprises a pair of parallel partially overlapping flexible reed contacts hermetically sealed in a tubular envelope and extending through ends thereof to provide external contacts. The preferred switch also comprises at least one non-magnetic member or a plurality of magnets for generally counteracting the electrostatic attraction produced between the open reed contacts while high voltage is applied to the switch.

35 Claims, 2 Drawing Sheets

HIGH VOLTAGE REED SWITCH

BACKGROUND

The present invention relates generally to magnetically operated switches for opening and closing circuits. More particularly, the invention relates to improved high voltage reed switches that reduce the effect of electrostatic pull between the open reed contacts thereof.

A conventional reed switch includes two flexible ferromagnetic reed switch contacts in a parallel partially overlapping arrangement, one contact sealed in each end of an hermetically sealed glass tube. When such a sealed reed contact arrangement is subjected to a magnetic field a flux path is established axially along one reed contact, across an air gap between the two reed contacts and axially along the second. The overlapping ends of the two reed contacts are thus oppositely polarized and attracted to one another, operating the reed switch. In practice, any given reed switch will be designed to operate and release at preselected magnetic flux densities by proper selection of reed contact materials and size of the gap between the overlapping portions of the reed contacts.

High voltage reed switches, for example, those handling more than 500 volts, are commonly known and used for various functions, such as in the operation of defibrillators. However, as high voltage is applied to an open reed switch, an electrostatic voltage is often produced across the open contacts. This electrostatic voltage creates an electrostatic attraction which pulls the contacts closer together thereby reducing the voltage hold-off of the switch or in some cases closing the contacts causing them to short out.

When the contacts close, the electrostatic voltage is temporarily eliminated and the contacts immediately reopen. This undesired closing and opening may be continuously repeated while voltage is applied to the open switch and can cause unnecessary wear on the reed contacts. Hence, conventional high voltage reed switches do not have low ampere turn sensitivity because at moderately high voltage the contacts are pulled so close together that they arc over or actually close.

Until now, no reed switch has been provided with an effective means for reducing the effect of the electrostatic attraction between the open reed contacts thereof while voltage is applied to the switch. For the foregoing reasons, there is a need for improved high voltage reed switches that are simple, economical and effective.

SUMMARY

The present embodiment of the invention is directed to a device that opens and closes a circuit in response to a magnetic flux field produced by a magnetic source. In particular, the device comprises a reed switch having a pair of parallel partially overlapping flexible reed contacts hermetically sealed in a tubular envelope and extending through ends thereof to provide external contacts. The preferred reed switch is evacuated through a tubulation on the envelope, thus providing a vacuum reed switch.

An undesired electrostatic attraction is often produced between the open reed contacts when high voltage, i.e., above about 500 volts, is applied to the external contacts of the reed switch. This electrostatic attraction pulls the open reed contacts toward one another and in some instances causes them to close. Hence, the preferred reed switch further comprises at least one non-magnetic member or a plurality of magnets for generally counteracting the electrostatic attraction and thereby reducing the effect of the electrostatic pull produced between the open reed contacts.

It is, therefore, a general object of the present invention to provide improved reed switches having means for reducing the effect of the electrostatic attraction between the open reed contacts thereof while voltage is applied to the switch.

BRIEF DESCRIPTION OF THE DRAWINGS

These and other features, aspects, and advantages of the present invention will become better understood with regard to the following description, appended claims, and accompanying drawings where:

DESCRIPTION

Figure 1:
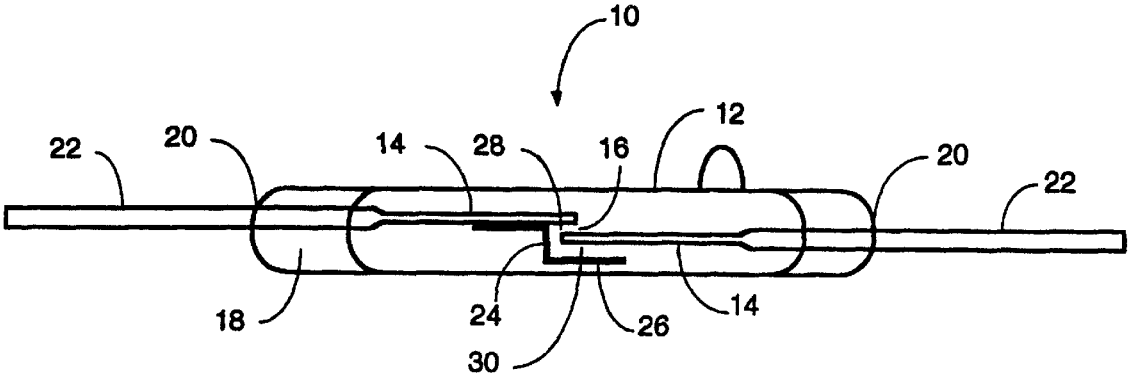
FIG. 1 is a front elevation view of a reed switch constructed in accordance with a present embodiment of the invention, wherein one reed contact has a member attached thereto for reducing the effect of the electrostatic attraction between the open reed contacts.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications, and equivalents, which may be included within the spirit and scope of the invention as defined by the appended claims.

As illustrated in FIGS. 1–4, the present embodiment of the invention relates to a switch means 10 for opening and closing a circuit in response to a magnetic flux. More specifically, the switch means 10 comprises a reed switch 12 capable of carrying high voltage, i.e., above about 500 volts, and more preferably above about 10,000 volts.

A preferred reed switch 12 is constructed in conventional manner with parallel partially overlapping flexible reed contacts 14 formed of ferromagnetic material such as nickel-iron alloy annealed to increase permeability, and tungsten or rhodium contacts. The overlapping reed contacts 14 have a gap 16 therebetween when the switch 12 is open, as shown in FIGS. 1–4, and are together when the switch 12 is closed (not shown).

The reed contacts 14 are hermetically sealed within a tubular glass envelope 18, wherein the contacts 14 extend through opposite ends 20 of the envelope 18 to provide external contacts 22. The external contacts 22 are in communication with the internal pair of aligned reed contacts 14. Further, the preferred reed switch 12 is evacuated through a tubulation on the envelop 20 to create a vacuum therein; thus, the preferred switch 12 is a vacuum reed switch.

The reed switch 12 is operatively opened and closed in response to a magnetic flux field produced by a magnetic source (not shown), which is oppositely polarized transversely through opposite ends thereof. The magnetic source may be a permanent magnet formed of any number of suitable ferromagnetic materials. Alternatively, any suitable electromagnet, coil or the like known in the art may be used to provide the magnetic flux for actuating the switch 12. When the magnetic source is placed in close proximity to the overlapping reed contacts 14, a magnetic flux is transferred through one contact 14 and an opposite magnetic flux is transferred to the other contact 14. Therefore, an opposite magnetic polarity is produced across the reed contacts 14.

The opposite magnetic polarity actuates the reed contacts 14 causing them to close and to complete the circuit connected between the external contacts 22. Removal of the magnetic source from the proximate position allows the contacts 14 to open thereby breaking the circuit.

When high voltage is applied to the external contacts 22 of the open reed switch 12, an electrostatic field is produced whereby electrostatic voltage is created across the open reed contacts 14. The electrostatic voltage increases as the voltage applied to the switch 12 is increased. The electrostatic voltage creates an electrostatic attraction which pulls the reed contacts 14 toward one another, thereby reducing the size of the gap 16 or in some instances closing the contacts 14. If the contacts 14 close, the electrostatic voltage is temporarily eliminated allowing the contacts 14 to immediately reopen.

Hence, the electrostatic field, which is created by applying high voltage to the external contacts 22, can cause the unactuated and open reed contacts 14 of the switch 12 to repeatedly close and reopen. This continuous closing and opening of the contacts 14 is undesired.

A preferred switch 12 constructed in accordance with a present embodiment of the invention comprises a means for reducing to a negligible amount the effect of the electrostatic pull between the open reed contacts 14 while voltage is applied to the switch 12. Further, the means for reducing the effect of the electrostatic pull prevents the electrostatic voltage from reducing the size of the gap 16 between the open contacts 14, and more specifically from pulling the contacts 14 toward one another thereby affecting the normal operation of the switch 12. Therefore, the preferred switch reduces the effect of the electrostatic pull, i.e., attraction, between the contacts 14.

As shown in FIG. 1, the means for reducing the effect of the electrostatic pull between the open reed contacts 14 comprises a member 24 attached to one of the reed contacts 14. The member 24 angularly extends from the attached contact 14 to form a distant end 26 that is substantially parallel thereto. A gap 28 is formed between the member 24 and the attached contact 14. The member 24 is preferably constructed of a non-magnetic material such as Monel metal, and is welded to the contact 14. Alternatively, the member 24 is constructed of a magnetic material.

The gap 28 between the member 24 and the attached contact 14 receives an end portion 30 of the opposing reed contact 14 therein. With the end portion 30 of the opposing reed contact received in the gap 28, the electrostatic voltage pulls the reed contacts 14 together, but the member 24 on the opposite side pulls the contacts 14 open. Therefore, the member 24 generally counteracts the electrostatic attraction between the open contacts 14 to reduce the effect of the electrostatic pull therebetween.

Figure 2:
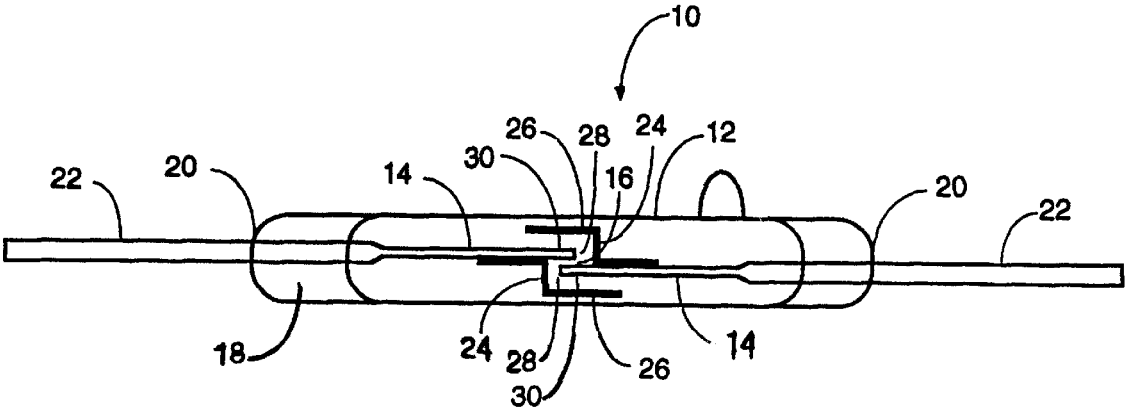
FIG. 2 is a front elevation view of a reed switch constructed in accordance with a present embodiment of the invention, wherein each reed contact has a separately attached member for reducing the effect of the electrostatic attraction between the open reed contacts.

Alteratively, as illustrated in FIG. 2, the means for reducing the effect of the electrostatic pull between the open reed contacts 14 comprises each contact 14 having a separate member 24 attached thereto. Each member 24 angularly extends from its attached contact 14 and has a distant end 26 that is substantially parallel thereto. The members 24 are constructed and attached to the contacts 14 as described hereinabove with respect to FIG. 1. A gap 28 is formed between each member 24 and its respectively attached contact 14 for receiving the end portion 30 of the opposing reed contact 14 therein.

While the electrostatic voltage pulls the reed contacts 14 together, the members 24 located on the opposite sides of the opposing contacts 14 pull the contacts 14 apart. Hence, the members 24 generally counteract the electrostatic attraction between the open contacts 14 to reduce the effect of the electrostatic pull therebetween.

With use of either one or a pair of members 24, as previously described, the reed switch 12 functions in a normal manner when the magnetic source (not shown) is brought into close proximity thereto, that is, the magnetic flux from the magnetic source is transferred through the reed contacts 14. Thus, an opposite magnetic polarity is transferred to the contacts 14 which pulls them together and closes the switch 12. With the effect of the electrostatic pull of the electrostatic voltage on the contacts 14 being reduced by the members 24, the amount of voltage applied to the open switch 12 may be substantially increased.

Figure 3:
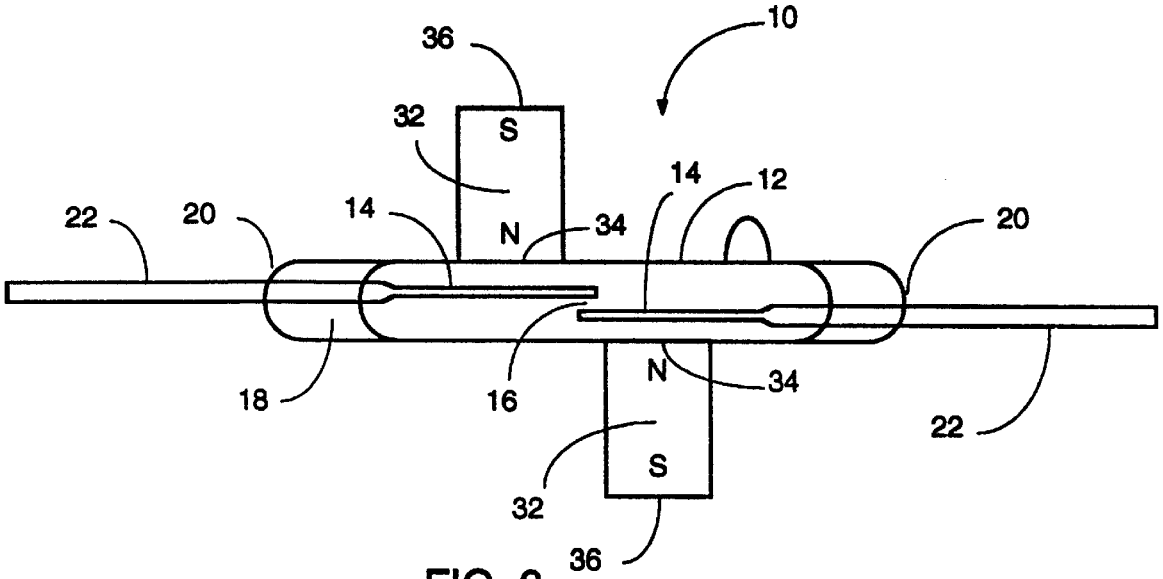
FIG. 3 is a front elevation view of a reed switch constructed in accordance with a present embodiment of the invention, wherein the switch includes a plurality of magnets for reducing the effect of the electrostatic attraction between the open reed contacts.
Figure 4:
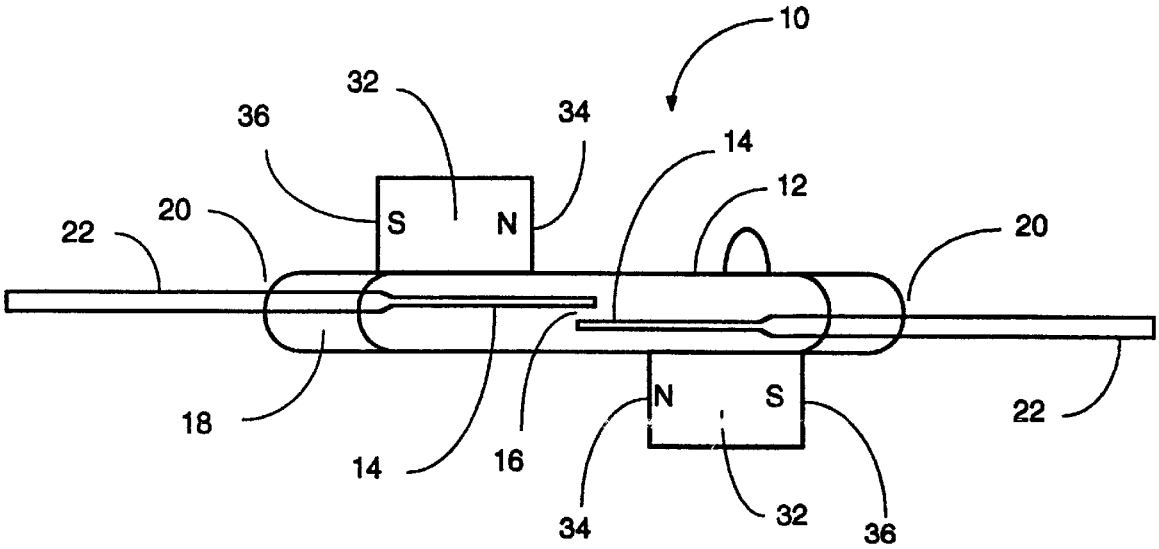
FIG. 4 is a front elevation view of a reed switch constructed in accordance with a present embodiment of the invention, wherein the switch includes a plurality of alternatively arranged magnets for reducing the effect of the electrostatic attraction between the open reed contacts.

Alternatively, as shown in FIGS. 3 and 4, the means for reducing the effect of the electrostatic pull between the open reed contacts 14 comprises a pair of magnets 32 positioned to transfer a like magnetic polarity across each reed contact 14. The like magnetic polarity causes the open contacts 14 to be pulled apart and repelled, thereby greatly increasing the voltage hold-off of the switch 12. Hence, the magnets 32 generally counteract the electrostatic attraction between the open contacts 14 to reduce the effect of the electrostatic pull therebetween.

In order to operatively close the switch 12, one of the magnets 32 can be removed or moved to aid the other magnet. Additionally, to operate the switch 12, the polarity of one magnet 32 can be reversed to provide an opposite polarity across the contacts 14, or a sufficient magnetic source may be used to overcome the magnets 32 and provide an opposite polarity across the contacts 14.

The pair of magnets 32 are oppositely polarized transversely through first and second ends 34, 36 thereof and may be variously arranged to produce the like magnetic polarity across the contacts 14, (see FIGS. 3 and 4). It is understood that either of the like poles of the magnets may be used to produce the like polarity across the contacts 14.

The magnets 32 may be formed of any number of suitable ferromagnetic materials known in the art. With the reed contacts 14 being pulled apart and repelled by the magnets 32, the amount of voltage applied to the open switch 12 can be substantially increased.

Alternatively, the magnets 32 may comprise any suitable electromagnets, coils or the like known in the art. If electromagnets are utilized, then a current can be reversed on one of the coils thereof to obtain operation of the switch 12.

The previously described versions of the invention disclose a novel form of reed switch 12 that is particularly useful in carrying high voltage while reducing the effect of the electrostatic attraction between the open reed contacts 14. The reduction of the effect of the electrostatic pull on the reed contacts 14 effectively increases the amount of voltage that the switch 12 can handle. Thus, the present invention is advantageous in providing improved high voltage reed switches 12.

The foregoing descriptions of specific embodiments of the present invention have been presented for purposes of illustration and description. They are not intended to be exhaustive or to limit the invention to the precise forms disclosed and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A device comprising:

a reed switch having first and second partially overlapping contacts which open and close in response to a change in magnetic flux;

wherein an electrostatic attraction is produced between said contacts when voltage is applied to said switch and said contacts are open, said electrostatic attraction pulls said open contacts toward one another; and means for reducing the effect of the electrostatic pull between said open contacts so that an opposed electrostatic force on one of said open contacts reduces the effect of said electrostatic attraction between said open contacts causing said open contacts either to resist closure if said opposed electrostatic force is relatively small or to move apart if said opposed electrostatic force is relatively large.

2. The device of claim 1 wherein the voltage is about 500 volts or greater.

3. The device of claim 1 wherein said means for reducing comprises a first member attached to said first contact.

4. The device of claim 3 wherein said first member and said first contact receive a portion of said second contact therebetween.

5. The device of claim 4 wherein said means for reducing comprises a second member attached to said second contact.

6. The device of claim 5 wherein said second member and said second contact receive a portion of said first contact therebetween.

7. The switch of claim 1 wherein said means for reducing comprises a first non-magnetic member attached to said first contact and a second non-magnetic member attached to said second contact.

8. The device of claim 1 wherein said switch has a vacuum therein.

9. A device comprising:

a reed switch having first and second partially overlapping contacts which open and close in response to a change in magnetic flux;

wherein an electrostatic attraction is produced between said contacts when voltage is applied to said switch and said contacts are open, said electrostatic attraction pulls said open contacts toward one another; and a first member attached to said first contact for reducing the effect of the electrostatic pull between said open reed contacts so that said electrostatic attraction pulling said open contacts toward one another is offset by an opposed electrostatic force between said first member and one of said contacts, said opposed electrostatic force causing said open contacts either to resist closure if said opposed electrostatic force is relatively small or to move apart if said opposed electrostatic force is relatively large.

10. The device of claim 9 wherein said first member and said first contact receive a portion of said second contact therebetween.

11. The device of claim 10 further comprising a second member attached to said second contact for reducing the effect of the electrostatic pull between said open contacts.

12. The device of claim 11 wherein said second member and said second contact receive a portion of said first contact therebetween.

13. The device of claim 12 wherein said first and second members are made of a non-magnetic material.

14. The device of claim 9 wherein the switch has a vacuum therein.

15. A device comprising:

a reed switch having first and second partially overlapping contacts which open and close in response to a change in magnetic flux;

means for reducing the effect of an electrostatic pull produced between said contacts when voltage is applied to said switch and said contacts are open; and wherein said means for reducing comprises a first member attached to one of said contacts so that an opposed electrostatic force between said first member and one of said open contacts causes said open contacts either to resist closure if said opposed electrostatic force is relatively small or to move apart if said opposed electrostatic force is relatively large.

16. The device of claim 15 wherein the voltage is about 500 volts or greater.

17. The device of claim 15 wherein said first member is comprised of a non-magnetic material.

18. The device of claim 15 wherein said switch contains a vacuum therein.

19. The device of claim 15 wherein said first member is attached to said first contact.

20. The device of claim 19 wherein said first member and said first contact receive a portion of said second contact therebetween.

21. The device of claim 20 wherein said means for reducing comprises a second member attached to said second contact.

22. The device of claim 21 wherein said second member and said second contact receive a portion of said first contact therebetween.

23. The device of claim 22 wherein said first and second members are comprised of a non-magnetic material.

24. A device comprising:

a reed switch having first and second partially overlapping contacts which open and close in response to a change in magnetic flux;

means for reducing the effect of an electrostatic pull produced between said contacts when voltage is applied to said switch and said contacts are open;

wherein said means for reducing comprises a first member attached to said first contact so that a first opposed electrostatic force between said first member and first said open contact causes said open contacts either to resist closure if said first opposed electrostatic force is relatively small or to move apart if said first opposed electrostatic force is relatively large; and wherein said means for reducing comprises a second member attached to said second contact so that a second opposed electrostatic force between said second member and said second open contact causes said open contacts either to resist closure if said second opposed electrostatic force is relatively small or to move apart if said second opposed electrostatic force is relatively large.

25. The device of claim 24 wherein the voltage is about 500 volts or greater.

26. The device of claim 24 wherein said switch contains a vacuum therein.

27. The device of claim 24 wherein said first member and said first contact receive a portion of said second contact therebetween.

28. The device of claim 27 wherein said second member and said second contact receive a portion of said first contact therebetween.

29. The device of claim 28 wherein said first member is comprised of a non-magnetic material.

30. The device of claim 29 wherein said second member is comprised of a non-magnetic material.

31. A reed switch, comprising:

first and second partially overlapping contacts defining a gap therebetween, wherein said contacts open and close in response to a change in magnetic flux, wherein an electrostatic attraction is produced between said contacts when voltage is applied to said reed switch whereby the electrostatic attraction pulls said contacts toward another across said gap; and reducing means for reducing the effect of electrostatic attraction between said contacts when voltage is applied to said reed switch so that an opposed electrostatic force on one of said open contacts reduces the effect of said electrostatic attraction between said open contacts causing said open contacts either to resist closure if said opposed electrostatic force is relatively small or to move apart if said opposed electrostatic force is relatively large.

32. The reed switch of claim 31 where said reducing means comprises a first member attached to said first contact so that said second contact is located between said first member and said first contact, whereby the electrostatic attraction between said first and second contacts is reduced by an electrostatic attraction between said first member and said second contact.

33. The reed switch of claim 32 wherein said reducing means further comprises a second member attached to said second contact so that said first contact is located between said second member and said second contact, whereby the electrostatic attraction between said first and second contacts is further reduced by an electrostatic attraction between said second member and said first contact.

34. The reed switch of claim 31 wherein the voltage is greater than about 10,000 volts.

35. The reed switch of claim 31 wherein the voltage is greater than about 500 volts.

* * * * *